US005463452A

United States Patent [19]

Inaba et al.

[11] Patent Number: 5,463,452

[45] Date of Patent: Oct. 31, 1995

[54] SINGLE-COMPONENT DEVELOPING APPARATUS

[75] Inventors: Shigeru Inaba; Masaaki Fukuhara; Makoto Hirota; Mitsuo Yamamoto; Jun Abe; Hideaki Miyata; Takayuki Sunaga; Toru Ishikawa; Yoshio Shiina; Toru Isosu; Makoto Kanno, all of Ebina, Japan

[73] Assignee: Fuji Xerox Co., Ltd., Tokyo, Japan

[21] Appl. No.: 195,049

[22] Filed: Feb. 14, 1994

Related U.S. Application Data

[63] Continuation of Ser. No. 830,568, Feb. 4, 1992, abandoned.

[30] Foreign Application Priority Data

Feb. 5, 1991 [JP] Japan ..... 3-035247

[51] Int. Cl.[6] ..... G03G 21/00

[52] U.S. Cl. ..... 355/246; 118/657; 355/251; 355/265

[58] Field of Search ..... 355/245, 208, 355/246, 259, 253, 250–252, 265; 118/658, 653, 657; 430/120, 122

[56] References Cited

U.S. PATENT DOCUMENTS

| | | | |
|---|---|---|---|
| 4,473,627 | 9/1984 | Kanbe et al. | 118/653 X |
| 4,480,911 | 11/1984 | Itaya et al. | 355/251 |
| 4,553,500 | 11/1985 | Itaya et al. | 118/657 |
| 4,565,438 | 1/1986 | Folkins | 118/658 X |
| 4,629,669 | 12/1986 | Shoji et al. | 430/122 |
| 4,797,335 | 1/1989 | Hiratsuka et al. | 118/653 X |
| 4,913,088 | 4/1990 | Kanbe et al. | 118/653 X |
| 4,935,784 | 6/1990 | Shigehiro et al. | 355/253 |
| 5,030,996 | 7/1991 | Tajima et al. | 355/246 |
| 5,066,979 | 11/1991 | Goto et al. | 355/208 |
| 5,086,728 | 2/1992 | Kinoshita | 355/246 X |
| 5,096,788 | 3/1992 | Kanbe et al. | 430/120 |
| 5,170,213 | 12/1992 | Yamaguchi et al. | 355/246 |
| 5,175,070 | 12/1992 | Tanikawa et al. | 430/122 |
| 5,187,523 | 2/1993 | Oswa | 355/253 X |
| 5,194,359 | 3/1993 | Kanbe et al. | 430/120 |
| 5,206,693 | 4/1993 | Folkins | 355/246 X |
| 5,212,524 | 5/1993 | Tanikawa et al. | 355/253 X |
| 5,220,383 | 6/1993 | Enoki et al. | 355/246 |

FOREIGN PATENT DOCUMENTS 3-111855 5/1991 Japan .

*Primary Examiner*—A. T. Grimley
*Assistant Examiner*—Shuk Y. Lee
*Attorney, Agent, or Firm*—Finnegan, Henderson, Farabow, Garrett & Dunner

[57] ABSTRACT

A single-component developing apparatus comprising a developer holding member having a peripheral surface, a power supply section applying an AC developing bias voltage to the developer holding member, the AC developing bias voltage having a waveform with predetermined minimum value, maximum value and period, an electrostatic latent image receiving member opposing the developer holding member across a gap having predetermined width, a developer supplying section supplying a developer to the developer holding member, and a developer regulating member forming developer into a thin layer on the peripheral surface of the developer holding member by pressing on the developer holding member.

In this arrangement the developer holding member transports the thin layer of developer towards the electrostatic latent image receiving member, and the transported thin layer of developer flies from the developer holding member across the gap to the electrostatic latent image receiving member in accordance with the AC developing bias voltage. The waveform of the AC developing bias voltage satisfies the inequality:

$$t_A/T \leqq 0.4$$

wherein $t_A$ is rise time from minimum value to maximum value, and T is the period.

12 Claims, 6 Drawing Sheets

SINGLE-COMPONENT DEVELOPING APPARATUS

This application is a continuation, of application Ser. No. 07/830,568 filed Feb. 4, 1992, now abandoned.

BACKGROUND OF THE INVENTION

1. Field of the Invention

The present invention relates to a single-component developing apparatus which develops latent electrostatic images using a single-component developer in such various types of reproducing apparatuses as electrophotographic copying machines or laser printers.

2. Discussion of the Related Art

Various types of developing apparatuses which develop latent electrostatic images on a latent image receiving member and which produce corresponding visible images on recording sheets are well known. Many of these apparatuses use single-component developer in the developing process. A schematic illustration of a developing apparatus which uses a single-component developer comprised of magnetic toner is shown, for example, in FIG. 1.

The apparatus in FIG. 1 uses a single-component magnetic toner 10 and typically comprises a hopper 1 for storing magnetic toner 10 and a magnetic roll 22. The magnetic roll 22 is formed by attaching a plurality of magnetic poles to the inside of a cylindrical sleeve 21. The cylindrical sleeve 21 is disposed within a developing roll 2 so as to be freely rotatable. Thus constituted, the developing roll 2 magnetically attracts magnetic toner 10 to cylindrical sleeve 21. A developer regulating member 3 extends downward into hopper 1 restricting magnetic toner 10 into a developing area, and pressing magnetic toner 10 into a thin layer of predetermined thickness onto a peripheral surface of developing roll 2.

Thus, in the single-component developing apparatus described above, magnetic toner 10 stored in hopper 1 contacts cylindrical sleeve 21. As the developing roll 2 is rotated, a quantity of magnetic toner 10 in the range of from 0.5 to 2.0 mg/cm2 adheres to the peripheral surface of cylindrical sleeve 21 by the combined action of developing roll rotation and of the developer regulating member 3. The adhering magnetic toner 10 is transported to a developing area facing an electrostatic latent image receiving member 4. The transported magnetic toner 10 has a charge of predetermined value. A biasing DC power supply 6 and a high-voltage AC power supply 5 are connected to cylindrical sleeve 21. AC power supply 5 applies a DC biased AC sine wave voltage to the cylindrical sleeve 21. An electric field formed between electrostatic latent image receiving member 4 and developing roll 2 causes charged magnetic toner 10 to fly onto the electrostatic latent image receiving member 4 and form a toner image 8 corresponding to an electrostatic latent image 7.

In the single-component developing apparatus described above a so-called toner chain, that is magnetic toner 10 flying from developing roll 2 to electrostatic latent image receiving member 4 in a row configuration or "a chain" arranged along a line of the magnetic force applied to electrostatic latent image receiving member 4, is frequently generated because the magnetic force of magnet roll 22 fixed inside of developing roll 2 also affects the developing area. Unfortunately, therefore, in transferring toner image to recording sheets, the toner chain creates a "tailing" effect, that is, creation of a large number of fine particle lines at the end of the toner image such as shown in FIG. 13 (A). The toner chain may also scatter magnetic toner particles during the process and cause a "blur" effect shown in FIG. 13 (B). As a result, serious defects may occur in the transferred images.

Further explanation of the formation of the toner chain in cases where DC biased AC voltage is applied as a developing bias voltage follows. As mentioned above, magnetic toner 10 formed into a thin layer on the developing roll 2 flies onto the electrostatic latent image receiving member 4 as the result of an alternating electric field biased with a DC developing bias voltage component. However, magnetic toner 10 does not fly straight onto the electrostatic latent image receiving member. Rather, it wavers in a gap separating developing roll 2 and electrostatic latent image receiving member 4 as the direction of the alternating electric field changes until it adheres to the electrostatic latent image receiving member 4. In other words, upon application of the developing bias voltage, which has a sine waveform as shown by the dotted line in FIG. 3, magnetic toner 10 is either attracted towards the electrostatic latent image receiving member 4, or towards the developing roll 2. As a result, magnetic toner 10 largely wavers in the magnetic field near the center of the gap between developing roll 2 and electrostatic latent image receiving member 4 as shown in FIG. 4., and adheres to the electrostatic latent image receiving member 4 only by being attracted to the electric potential of the electrostatic latent image 7 as it comes into a peripheral portion of the gap where the electric field has a less effect. Accordingly, adhering magnetic toner 10 is influenced by the magnetic field (shown as broken lines in FIG. 4) more strongly than by the electric field, and the range of influence along a toner chain varies along the lines of magnetic force.

SUMMARY OF THE INVENTION

The present invention has been made in view of the above circumstances and has as an object to remedy the adverse image affects caused by the erratic flying of magnetic toner under the above-mentioned conditions.

A further object of the present invention is to prevent toner chain formation in the developing area and to provide a single-component developing apparatus which produces recorded images of high quality.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the single-component developing apparatus of this invention comprises a developer holding member having a peripheral surface, a power supply section applying an AC developing bias voltage to the developer holding member, the AC developing bias voltage having a waveform with predetermined minimum value, maximum value and period, an electrostatic latent image receiving member opposing the developer holding member across a gap having predetermined width, a developer supplying section supplying a developer to the developer holding member, and a developer regulating member forming developer into a thin layer on the peripheral surface of the developer holding member by pressing on the developer holding member. In this arrangement the developer holding member transports the thin layer of developer towards the electrostatic latent image receiving member, and the transported thin layer of developer flies from the developer holding member across the gap to the electrostatic latent image receiving member in accordance with the AC developing bias voltage. The waveform of the AC developing bias voltage satisfies the inequality:

$$t_A/T \leqq 0.4$$

wherein $t_A$ is rise time from minimum value to maximum value, and T is the period.

BRIEF DESCRIPTION OF THE DRAWINGS

The accompanying drawings, which are incorporated in and constitute a part of this specification illustrate embodiments of the invention and, together with the description, serve to explain the objects, advantages and principles of the invention. In the drawings.

DETAILED DESCRIPTION OF THE PREFERRED EMBODIMENTS

The present invention provides that formation of the toner chain is restrained if the rising speed of the voltage which attracts toner to electrostatic latent image receiving member 4 is faster than the falling speed of the voltage which attracts the toner to the developing roll 2. This phenomena will be explained using, for example, the developing bias voltage having a waveform shown by the solid line in FIG. 3.

Figure 3:
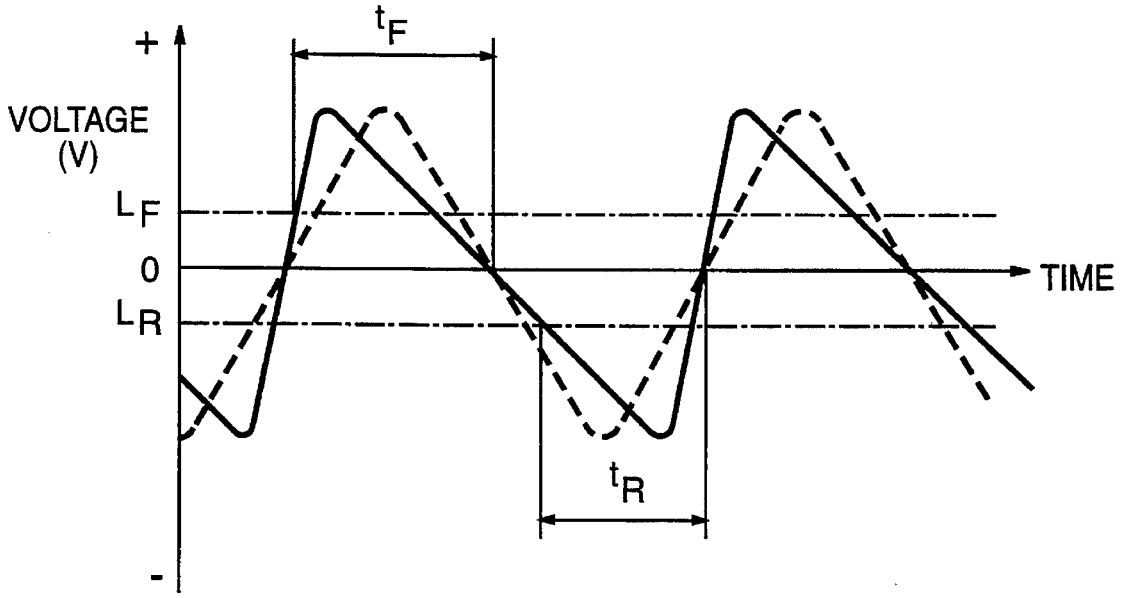
FIG. 3 is a graph explaining the action of the developing bias voltage in the present invention.
Figure 4:
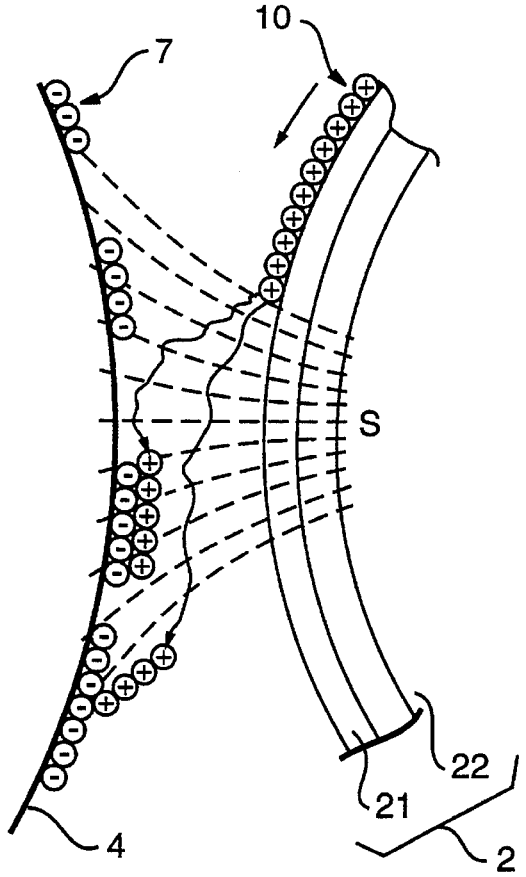
FIG. 4 is an enlarged view showing the toner flying across the gap in the developing area.

The developing bias voltage of FIG. 3 illustrates the case wherein magnetic toner is positively charged, and wherein magnetic toner is attracted to the electrostatic latent image receiving member 4 when the electric potential is positive, and magnetic toner is attracted to the developing roll 2 when the electric potential is negative. In FIG. 3, the DC bias voltage is assumed set to zero volts for simplicity of example.

When the developing bias voltage exceeds a certain value $L_F$, adhering magnetic toner begins to fly towards the electrostatic latent image receiving member 4 when the attraction force of the electrostatic latent image receiving member 4 exceeds the attraction force of the cylindrical sleeve 21. The magnetic toner then stays on the electrostatic latent image receiving member 4 until the polarity of the voltage goes negative. The time required for the magnetic toner to fly and stay is indicated as $t_F$. On the other hand, when the developing bias voltage falls below a certain value $L_R$, magnetic toner on the electrostatic latent image receiving member 4 begins to fly towards the cylindrical sleeve 21 when the attraction force of the cylindrical sleeve 21 exceeds the attraction force of the electrostatic latent image receiving member 4. The magnetic toner then stays on the cylindrical sleeve until the polarity of the voltage goes positive. The time required for the magnetic toner to fly and stay is indicated as $t_R$.

FIG. 3 shows $t_F$ and $t_R$, in which $t_F$ is longer than $t_R$. Accordingly, magnetic toner 10 wavers closer to the surface of the electrostatic latent image receiving member 4 in comparison with the conventional apparatus and is attracted to the electrostatic latent image 7 in a position where the alternating electric field sufficiently affects it. Magnetic toner 10 adhering to the electrostatic latent image receiving member 4 is, thus, influenced more strongly by the electric field than by the magnetic field and formation of toner chain is restrained.

Figure 2:
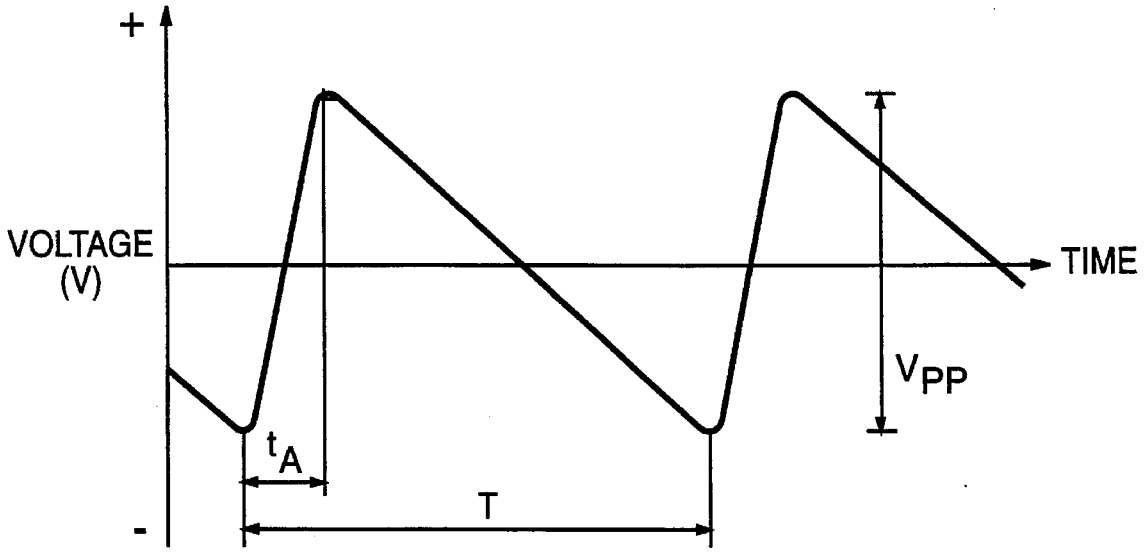
FIG. 2 is a graph showing a waveform of a developing bias voltage with respect to the first embodiment of the present invention.
Figure 5:
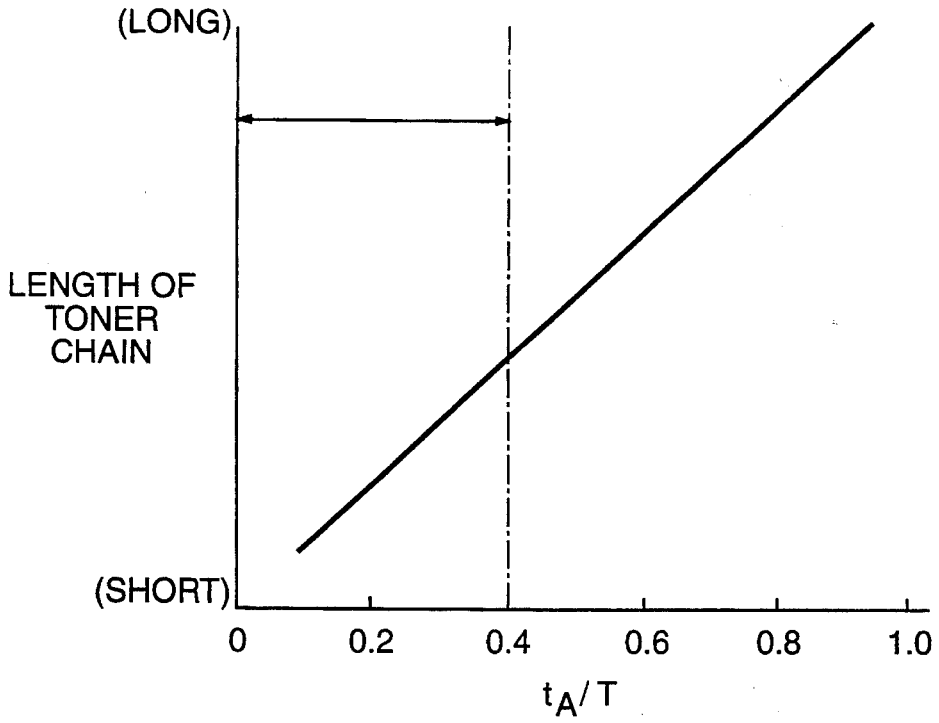
FIGS. 5–7 are graphs respectively showing the results of the experiments with respect to the present invention.

To understand the effect of the developing bias voltage in detail, the present invention describes that changes in the length of toner chain formation in terms of $t_A/T$, wherein $t_A$ is the time from maximum voltage attracting magnetic toner to the developing roll 2 to maximum voltage attracting the toner to the electrostatic latent image receiving member 4, and wherein T is one period of the voltage as shown in FIG. 2. The result of this relationship is shown in a graph of FIG. 5. According to these results, toner chain becomes longer as $t_A/T$ increases. Thus, to prevent the occurrence of "tailing" or "blur" in the transferred image, the ratio of $t_A$ to T, that is $t_A/T$ should be less than or equal to 0.4.

In the above described apparatus, it is necessary that the magnetic toner transported to the developing area is fully charged in order for the present invention to have full effect. Therefore, in the present invention, the developer regulating member presses upon the peripheral surface of the rotating developing roll to increase the amount of the charged developer. This characteristic will be more fully explained in a comparative example which follows three illustrative embodiments.

First Embodiment

Figure 1:
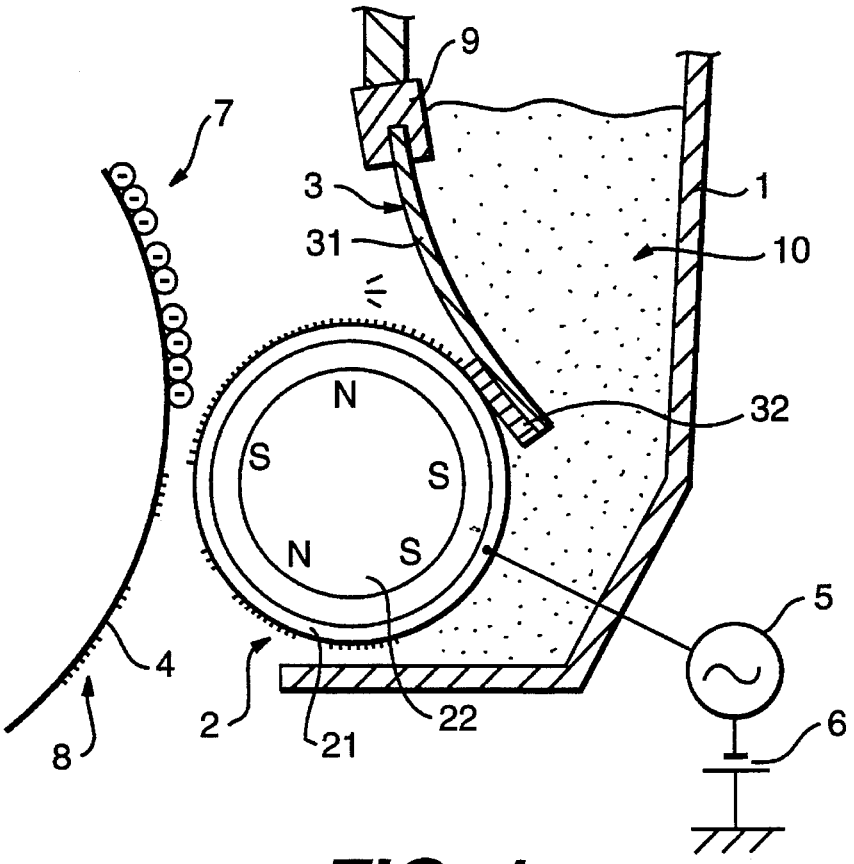
FIG. 1 is a schematic view showing the single-component developing apparatus of the first embodiment of the present invention.

A first embodiment of the present invention is an application to a single-component developing apparatus identical in construction to the single-component developing apparatus shown in FIG. 1 which uses positively charged magnetic toner as developer. That is, it comprises a developing roll 2 opposing an electrostatic latent image receiving member 4 across a gap of predetermined width, and a developer regulating member 3 adjacent to developing roll 2 and placed in a hopper 1 storing magnetic toner 10. A high-voltage AC power supply 5 and a biasing DC power supply 6 are connected to the developing roll 2 to provide a developing bias voltage.

The developing roll 2 described above comprises a magnet roll 22 to which plural magnetic poles (N . . . , S . . . ) which differ in polarity and the magnetic force are adhered, and is fastened to a casing (not shown in the drawings), and a cylindrical sleeve 21 rotating around the magnet roll 22. According to magnetic field patterns produced by magnet roll 22, magnetic toner 10 adheres to, the cylindrical sleeve 21 and subsequently is transported and released as the cylindrical sleeve 21 rotates. In this embodiment, a semi-conductive sleeve is used for the cylindrical sleeve 21, which is made of conductive material incorporated phenol resin having $4.2\times10^{10}\Omega$.cm resistivity value, formed into a cylindrical body of 1.0 mm thickness and having its surface polished in a longitudinal direction until a value of Rz prescribed in JIS B0601 10 point height of irregularities satisfies Rz=4.3μm.

Hopper 1 described above is disposed to enclose a lower portions and side portions of developing roll 2. Therefore, magnetic toner 10 piles at the back of developing roll 2 and is continuously supplied to the surface of the cylindrical sleeve 21 which passed upon the rotation through the developing area. In this embodiment, the magnetic toner particle contains 50 percent by weight of the magnetic powder.

The developer regulating member 3 described above is formed by vulcanizing or otherwise adhering a soft elastic member 32 made of silicone rubber of 50° rubber hardness and 1 mm thickness to a head of a spring plate member 31 made of non-magnetic stainless steel (SUS304 3/4H) of 0.1 mm thickness. The developer regulating member 3 is supported by holder 9 so that a free end of developer regulating member 3 extends in a direction opposite to rotation of cylindrical sleeve 21 and soft elastic member 32 contacts cylindrical sleeve 21 with 100 g/cm of linear pressure. According to results of experiments on this embodiment, the adhesion quantity of magnetic toner 10 formed into a thin layer on the cylindrical sleeve 21 by developer regulating member 3 is in the order of 1.0 mg/cm2.

This embodiment is characterized by a waveform of the developing bias voltage applied to the cylindrical sleeve 21 by the high-voltage AC power supply 5 and the DC power supply 6 described above. This DC biased AC voltage has a waveform as shown in FIG. 2, wherein frequency f is 2.4 kHz, voltage Vpp is 2 kV (peak-to-peak), DC voltage is −300 V and the time from minimum voltage to maximum voltage (tA) is in the order of ⅙ as long as the period T.

This embodiment of the present invention has been installed in a single-component developing apparatus constructed as described above in a copying machine and copies of improved quality thereby obtained. The electrostatic latent image receiving member 4 used in the foregoing experiment is a photoconductive drum having a surface consisting of an organic photoconductor uniformly negative charged after application to its peripheral surface of a predetermined potential (e.g., −600V) by a charging apparatus not shown. The electrostatic latent image 7 is formed by lowering the potential of a back portion to another predetermined potential (e.g., −200V) by exposure. The developing apparatus is placed in a copying machine such that a gap between the electrostatic latent image receiving member 4 and the cylindrical sleeve 21 of the developing roll 2 is approximately 230μm.

Under these conditions, very distinct images without "tailing" or "blur" were obtained. The toner chain formed on the electrostatic latent image receiving member 4 in this embodiment were remarkably shorter than toner chains typically appearing when a conventional developing bias voltage is applied.

Figure 6:
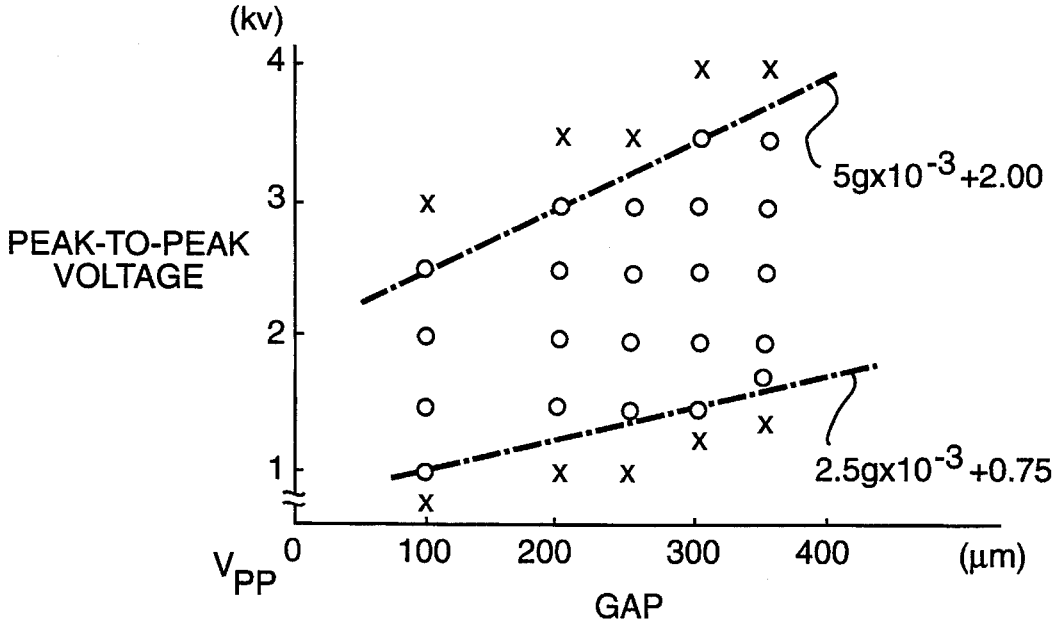

A clear relationship exists between the peak-to-peak voltage Vpp of the developing bias voltage waveform and the gap between the developing roll 2 and the electrostatic latent image receiving member 4. This relationship is illustrated in FIG. 6., wherein a mark x indicates that background fog, leakage of the developing bias voltage, or other inappropriate image density has occurred, and a mark O means that the obtained images are of improved quality. According to the foregoing relationship, improved images are obtained when voltage Vpp (kV) and the gap satisfy the following inequality:

$$(2.5\times10^{-3})g+0.75\leqq Vpp\leqq(5\times10^{-3})g+2.0$$

Where g is the width of the gap expressed in μm and wherein g is predetermined to range from 100μm to 400μm and more desirably, from 150μm to 300μm.

Figure 7:
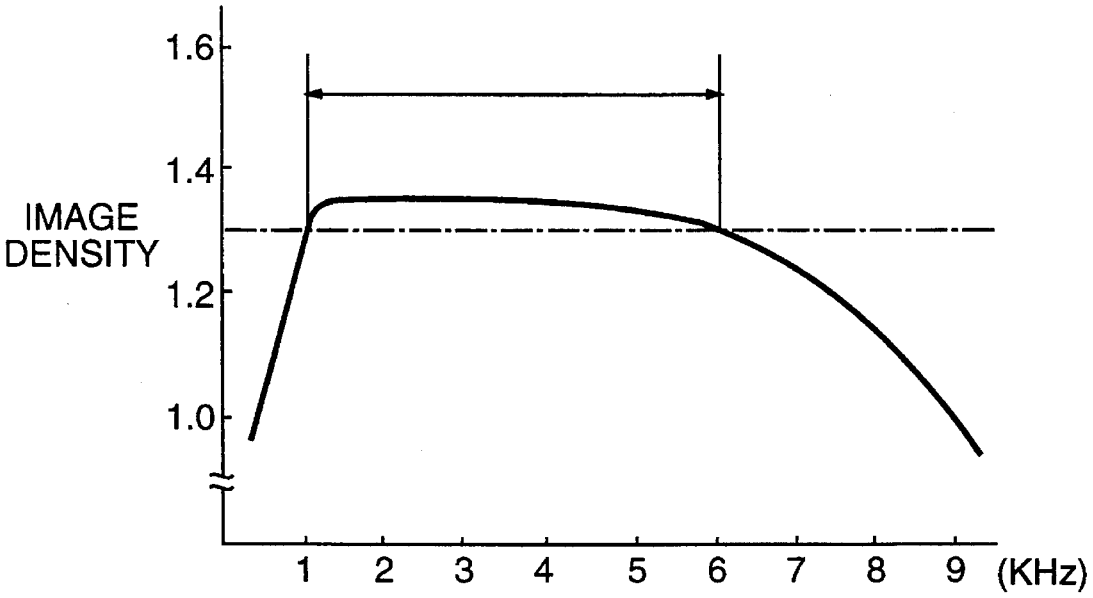

The relationship between the frequency of the voltage f(kHz) and the image density, within the range of the above-mentioned voltage Vpp, is shown in FIG. 7. (Experimentally, frequency f was changed and the resulting image density measured with a Macbeth densitometer.) According to this relationship, sufficient image density is obtained where f ranges so as to satisfy the following inequality:

$$1.0\text{ kHz}\leqq f\leqq 6.0\text{ kHz}$$

Experiments have shown that magnetic toner 10 does not fly satisfactorily from the developing roll 2 if the value of f is less than 1.0 KHz, and that magnetic 10 toner flying does not overtake the change of the electric field if the value of f is greater than 6.0 kHz.

Second Embodiment

Figure 8:
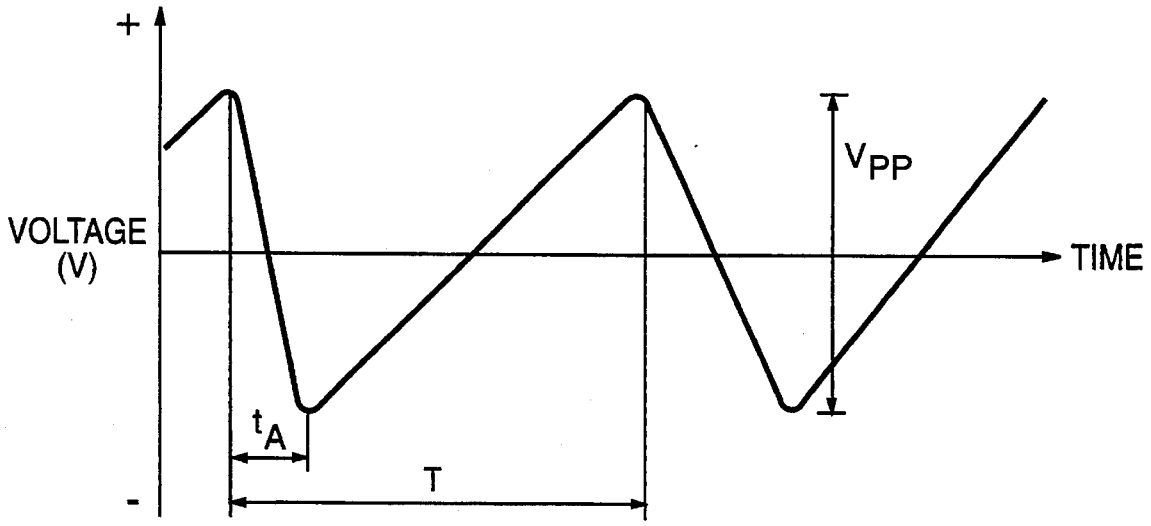
FIG. 8 is a graph showing a waveform of a developing bias voltage with respect to the second embodiment of the present invention.

The second embodiment of the present invention is an application to a single-component developing apparatus identical in construction to the single-component developing apparatus shown in FIG. 1 which uses negatively charged magnetic toner as developer. However, as shown in FIG. 8, the positive and negative components of the AC waveform of the developing bias voltage applied to the cylindrical sleeve 21 are reversed relative to the first embodiment because negatively charged toner is used instead of positively charged toner. Therefore, in the second embodiment, frequency f is 2.4 kHz, voltage Vpp is 2 kV (peak-to-peak), DC voltage is −200 V, and the time from maximum voltage to minimum voltage (tA) is in the order of ⅙ as long as the period T.

The electrostatic latent image receiving member 4 is an organic photoconductor negatively charged as in the first embodiment. However, formation of the electrostatic latent image 7 requires lowering the potential of the image portion by exposure after uniformly charging the surface of the electrostatic latent image receiving member 4. For example, the potential of the image portion and the back portion in this case are −150 V and −450 V, respectively. By using the developing apparatus described above, distinctly recorded images without "tailing" or "blur" are obtained as with as the first embodiment.

Similar to the first embodiment, examinations regarding to relationship between Vpp and the gap, and the frequency f have been made here. According to these relationships, improved images are obtained when Vpp and g satisfy the following inequality:

$$(2.5\times10^{-3})g+0.75\leqq Vpp\leqq(5\times10^{-3})g+2.0$$

Images have sufficient image density when frequency f of AC voltage satisfies the following inequality:

$$1.0\text{ kHz}\leqq f\leqq 6.0\text{ kHz}$$

Third Embodiment

A cylindrical sleeve having $5\times10^{7}\Omega$.cm resistivity and an 8.0 (+2.5 or −1.5) Rz prescribed in JIS B0601 10 point height of irregularities was used in the third embodiment. The developing bias voltage was predetermined to be −80 V, wherein developing bias voltage leakage easily occurs under ordinary condition. The third embodiment was carried out under conditions of a temperature of 28° C. and humidity of approximately 85% RH, the frequency of developing bias voltage was predetermined to be 2.4 kHz and tA/T=0.2.

By changing the value of the developing bias voltage Vpp and the width of the gap between the developing roll and the electrostatic latent image receiving member the present invention examined the relationship between developing bias voltage Vpp and the gap to the occurrence of discharge breakdown. According to the forgoing examination, when the gap width ranges from 125μm to 200μm no white spot occurs in the solid images until Vpp reached 1.8kV. When the gap width ranges from 200μm to 300μm no white spot occurs until Vpp reached 2.0kV. Consequently, it has been confirmed that the gap width has wide latitude for changes in the developing bias voltage. In the case of a cylindrical sleeve having $5\times10^{6}$~$10^{8}\Omega$.cm resistivity, similar results were also obtained.

The third embodiment of the present invention was also considered as described above, except that an ordinary sine wave was used as the developing bias voltage having a frequency of 2.0 kHz. As a result, discharge breakdown occurs where the gap width ranges from 150μm to 200μm and Vpp≧1.6 kV, and where the gap width ranges from 200μm to 300μm, and Vpp>1.8 kV.

By way of further comparison, the third embodiment of the present invention was considered as described above except that a rectangular wave having a duty ratio of 1:2.75 was used as the developing bias voltage at a frequency of 1.8 kHz. As a result, where the gap width ranges from 125μm to 175μm, the discharge breakdown occurred for Vpp which reaches 1.2 kV, and where the gap width ranges from 175μm to 300μm, the discharge breakdown occurred for Vpp>1.8 kV.

Comparative Example

Figure 9:
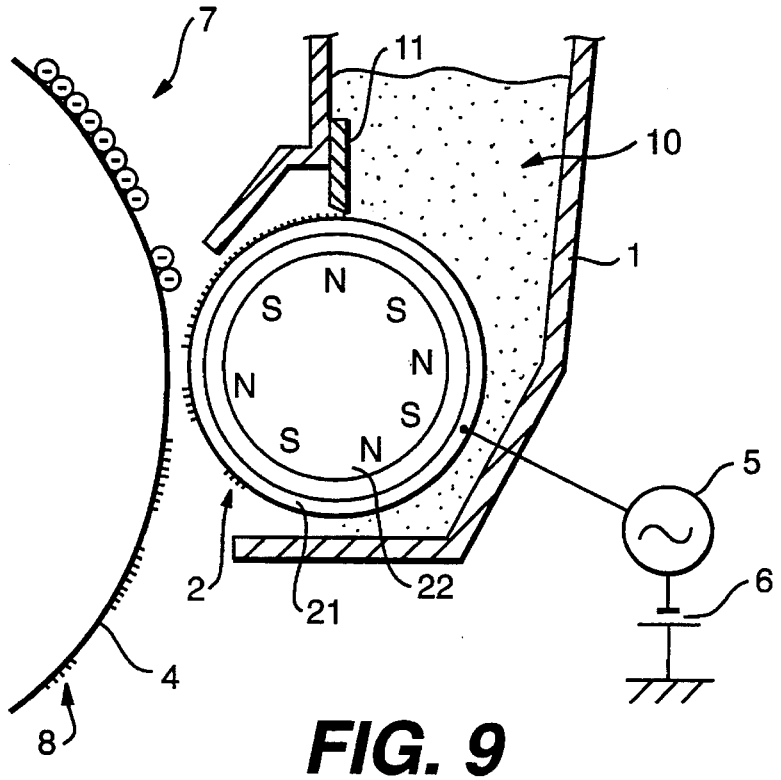
FIG. 9 is a schematic view showing the single-component developing apparatus of the reference example.

As shown in FIG. 9, the formation of toner chain was considered where the present invention is applied to a developing apparatus having a trimmer bar 11 adjacent to but spaced from cylindrical sleeve 21 of developing roll 2. The construction of the single component developing apparatus is otherwise identical to the apparatus of the first embodiment except that the trimmer bar 11 replaces the developer regulating member 3. Therefore, similar numbers are used in FIG. 9 to identify apparatus in the formation of a thin layer of magnetic toner components common with the first embodiment and their explanations are accordingly omitted.

Figure 10:
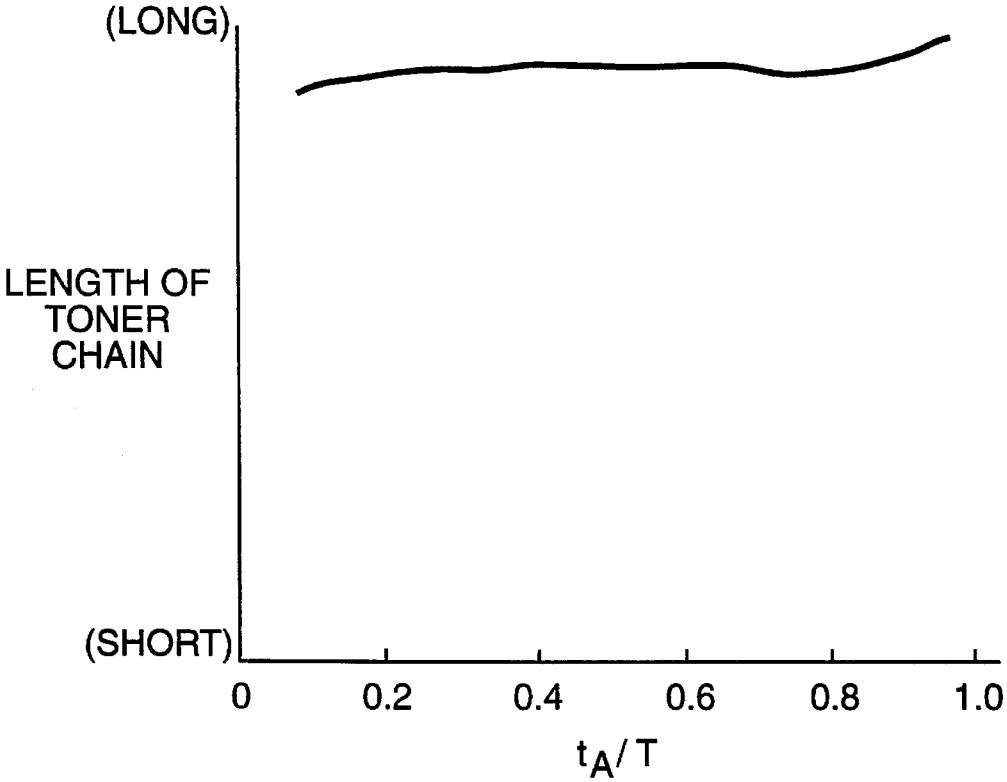
FIG. 10 is a graph showing the results of the reference example.

The developing bias voltage having a waveform as shown in FIG. 2 is applied to the cylindrical sleeve 21 of the developing roll 2. It is then observed how the length of the toner chain adhering to the electrostatic latent image receiving member 4 changes as tA/T changes. The results are shown in FIG. 10. According to these results, the present invention has little effect in apparatuses like the one shown in FIG. 9.

Figure 11:
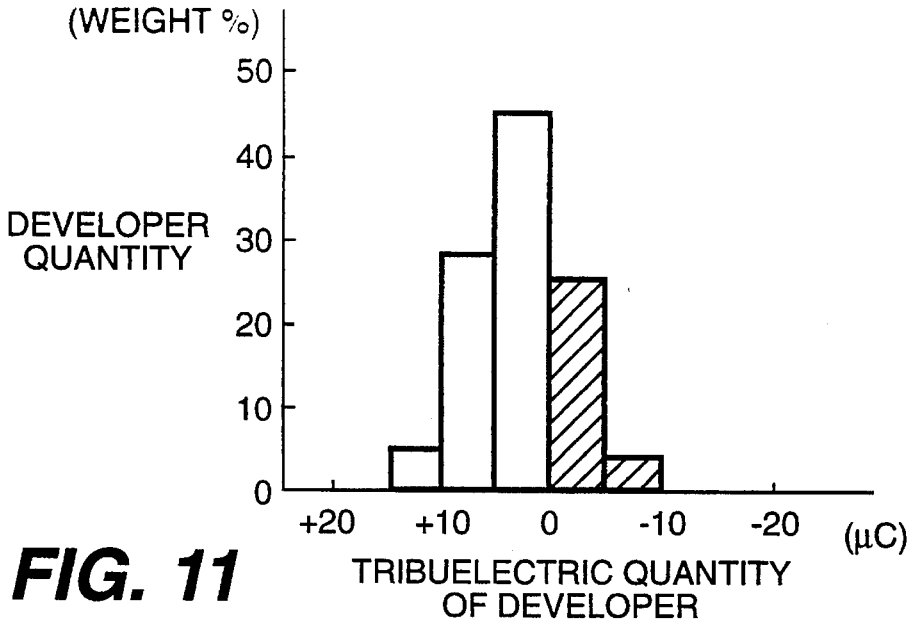
FIGS. 11 and 12 are graphs respectively showing distribution of toner charging in the reference example and the present invention.
Figure 12:
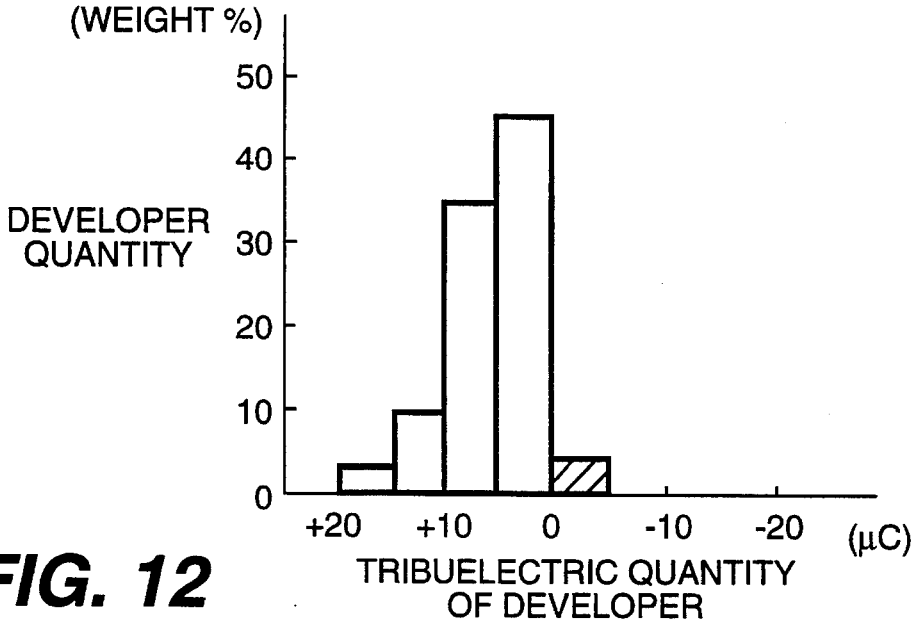
Figure 13A:
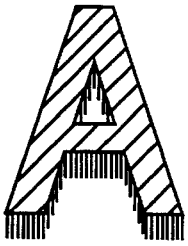
FIGS. 13(A) and 13(B) are views respectively showing "tailing" and "blur" effects on the recorded images.
Figure 13B:
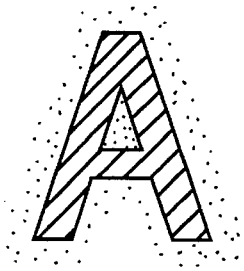

This phenomenon is explained by the difference in the quantity of magnetic toner charging distribution. As FIGS. 11 and 12 illustrate, magnetic toner charging distribution in the comparative example and magnetic toner charging distribution in the present invention respectively. According to FIG. 11 and 12, an average charging quantity of magnetic toner in the comparative example using the trimmer bar is small, 0.71μC/g, and 28 percent of the magnetic toner by weight is defectively charged. However, as shown in FIG. 12 an average charging quantity of magnetic toner in the present invention using the developer regulating member 3 is 10.48μC/g and only 4 percent of the magnetic toner by weight is defectively charged. That is, in the first and second embodiments, the developer regulating member 3 provides improved capability for uniform charging because it presses on the developing roll to form magnetic toner into the thin layer. In contrast, the comparative example using the trimmer bar, provides unsatisfactorily charged magnetic toner because charging of the toner depends on friction between magnetic toner and cylindrical sleeve. If the charge of the magnetic toner is small, the electric force from the electric field will also be small. Therefore, the advantageous effects of the developing bias voltage waveform in the present invention is less than in the comparative example. In the first and second embodiments, a semi-conductive sleeve is used as the cylindrical sleeve 21 of the developing roll 2, however, a conductive sleeve such as one made of metal, etc. or a sleeve with a surface coating of oxide, ceramics, resin may also be used in the present invention.

Furthermore, it is not necessary for the developer regulating member 3 to extend in a direction opposite to rotation of developing roll 2, that is, forward direction is allowed. Based on the foregoing description the present invention is very effective if it is applied to the single-component developing apparatus having the developer regulating member 3 to form magnetic toner into a thin layer by pressing on the developing roll.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A single-component developing apparatus comprising:

a developer holding member having a magnetic member therein and a peripheral surface;

power supply means for applying an AC developing bias voltage to the developer holding member, said AC developing bias voltage having a waveform with predetermined minimum value, maximum value and period, said AC developing bias voltage rising gradually from said minimum value to said maximum value and falling gradually from said maximum value to said minimum value;

an electrostatic latent image receiving member opposing the developer holding member across a gap having predetermined width;

developer supplying means for supplying a developer to the developer holding member; and a developer regulating member in pressing engagement with the developer holding member, forming the developer into a thin layer on the peripheral surface of the developer holding member, wherein the developer holding member transports the thin layer of developer towards the electrostatic latent image receiving member, wherein the transported thin layer of developer flies from the developer holding member across the gap to the electrostatic latent image receiving member in accordance with the AC developing bias voltage, wherein the waveform of the AC developing bias voltage satisfies the inequality:

$$T_A/T \geqq 0.4$$

wherein $t_A$ is rise time from the minimum value to the maximum value, and T is the period.

2. The single-component developing apparatus of claim 1, wherein the developer is positively charged.

3. The single-component developing apparatus of claim 2, wherein the minimum value attracts the transported developer to a developing holding means and the maximum value repels the transported developer from the developing holding means towards the electrostatic latent image receiving member.

4. The single-component developing apparatus of claim 1, wherein the power supply means includes an AC power supply and a DC power supply, and wherein the AC developing bias voltage has a DC bias.

5. The single-component developing apparatus of claim 1, wherein the developer regulating member includes a non-magnetic support member attached to the developer supplying means and an elastic member attached to the support member and pressing upon the surface of the developer holding member.

6. A single-component developing apparatus comprising:

a developer holding member having a magnetic member therein and a peripheral surface;

power supply means for applying an AC developing bias voltage to the developer holding member, said AC developing bias voltage having a waveform with predetermined minimum value, maximum value and period, said AC developing bias voltage rising gradually from said minimum value to said maximum value and falling gradually from said maximum value to said minimum value;

an electrostatic latent image receiving member opposing the developer holding member across a gap having predetermined width;

developer supplying means for supplying a developer to the developer holding member; and a developer regulating member in pressing engagement with the developer holding member, forming the developer into a thin layer on the peripheral surface of the developer holding member;

wherein the developer holding member transports the thin layer of developer towards the electrostatic latent image receiving member, wherein the transported thin layer of developer flies from the developer holding member across the gap to the electrostatic latent image receiving member in accordance with the AC developing bias voltage, wherein the waveform of the AC developing bias voltage satisfies the inequality:

$$t_A/T<0.4$$

wherein $t_A$ is rise time from the minimum value to the maximum value, and T is the period, and wherein the predetermined width of the gap and the AC developing bias voltage waveform satisfy the following unitless equation:

$$(2.5\times10^{-3})g+0.75 \leqq V_{pp}(5\times10^{-3})g+2.0$$

wherein g is the predetermined width expressed in μm and $V_{pp}$ is peak-to-peak voltage expressed in kV.

7. The single-component developing apparatus of claim 6, wherein g ranges from 100 μm to 400 μm.

8. The single-component developing apparatus of claim 1, wherein the developing bias voltage has a frequency in the range of from 1.0 kHz to 6.0 kHz.

9. The single-component developing apparatus of claim 1, wherein the developer is negatively charged.

10. The single-component developing apparatus of claim 9, wherein the maximum value attracts the transported developer to a developing holding means and the minimum value repels the transported developer from the developing holding means towards the electrostatic latent image receiving member.

11. A single-component developing apparatus comprising:

a developer holding member having a magnetic member and a peripheral surface;

power supply means for applying an AC developing bias voltage to the developer holding member, said AC developing bias voltage having a waveform with predetermined minimum value, maximum value and period, said AC developing bias voltage rising gradually from said minimum value to said maximum value and falling gradually from said maximum value to said minimum value;

an electrostatic latent image receiving member opposing the developer holding member across a gap having predetermined width;

developer supplying means for supplying a developer to the developer holding member; and a developer regulating member for engaging the developer holding member and pressing with linear pressure on the developer holding member to form developer into a thin layer on the peripheral surface of the developer holding member;

wherein the developer holding member transports the thin layer of developer toward the electrostatic latent image receiving member, wherein the transported thin layer of developer flies from the developer holding member across the gap to the electrostatic latent image receiving member in accordance with the AC developing bias voltage, wherein the waveform of the AC developing bias voltage satisfies the inequality:

$$t_A/T<0.4$$

wherein tA is fall time from maximum value to minimum value, and T is the period, and wherein the predetermined width of the gap and the AC developing bias voltage waveform satisfy the following unitless equation:

$$(2.5\times10^{-3})g+0.75 \leqq V_{pp} \leqq (5\times10^{-3})g+2.0$$

wherein g is the predetermined width expressed in μm and $V_{pp}$ is peak-to-peak voltage expressed in kV.

12. The single-component developing apparatus of claim 11, wherein g ranges from 100 μm to 400 μm.

* * * * *

UNITED STATES PATENT AND TRADEMARK OFFICE

CERTIFICATE OF CORRECTION

PATENT NO. : 5,463,452

DATED : October 31, 1995

INVENTOR(S) : Shigeru INABA et al

It is certified that error appears in the above-indentified patent and that said Letters Patent is hereby corrected as shown below:

Claim 1, Column 9, Line 5, "$T_A/T \geqq 0.4$" should read --$t_A/T \leqq 0.4$--;

Claim 11, Column 10, Line 54, "tA" should read --$t_A$--.

Signed and Sealed this

Nineteenth Day of November, 1996

*Attest:*

*Attesting Officer*

BRUCE LEHMAN

*Commissioner of Patents and Trademarks*